US005242323A

United States Patent [19]

Rappaport

[11] Patent Number: 5,242,323

[45] Date of Patent: Sep. 7, 1993

[54] AIR-PULSE POWERED TOY BOW AND ARROW SET

[76] Inventor: Mark Rappaport, 1900 Vorhees Ave., Unit C, Redondo Beach, Calif. 90278

[21] Appl. No.: 913,891

[22] Filed: Jul. 16, 1992

[51] Int. Cl.[5] ..... A63H 33/40; A63H 27/26; A63H 29/00; F41B 11/00

[52] U.S. Cl. ..... 446/180; 446/211; 446/430; 124/63; 124/66

[58] Field of Search ..... 446/180, 186, 197, 211, 446/212, 429, 430, 473; 124/56, 60, 63, 64, 65, 66, 67, 25.7, 25.5

[56] References Cited

U.S. PATENT DOCUMENTS

| | | | |
|---|---|---|---|
| 182,899 | 10/1876 | Cross | 124/67 |
| 2,069,821 | 2/1937 | Douglas | 124/67 |
| 2,099,957 | 11/1937 | Graham | 446/429 X |
| 2,315,242 | 3/1943 | Briggs et al. | 124/65 X |
| 2,526,305 | 10/1950 | VanBlarcom | 124/67 |
| 3,271,033 | 9/1966 | Parker | 124/65 X |
| 4,076,006 | 2/1978 | Breslow et al. | 446/212 X |
| 4,848,307 | 7/1989 | Tsao | 124/66 X |
| 5,119,796 | 6/1992 | Anderson | 124/24.1 X |

FOREIGN PATENT DOCUMENTS

| | | | |
|---|---|---|---|
| 568468 | 10/1957 | Italy | 124/65 |
| 137075 | 9/1947 | United Kingdom | 124/66 |
| 1445937 | 8/1976 | United Kingdom | 124/66 |
| 2174312 | 11/1986 | United Kingdom | 446/180 |

*Primary Examiner*—Robert A. Hafer
*Assistant Examiner*—D. Neal Muir
*Attorney, Agent, or Firm*—Michael Ebert

[57] ABSTRACT

An air-pulse powered arrow shooting toy set provided with at least one soft arrow whose shaft is formed of resilient, flexible foam material, the rear section of the shaft having an axial bore so that the arrow is slidable onto a launching tube which then extends into the bore. Coupled to the tube is an air gun which, when cocked and then fired, produces a compressed air pulse which is delivered to the launching tube to shoot off the arrow. The air gun includes a barrel having a piston slidable therein which is attached to a piston rod that extends out of one end of the barrel to join a handle. Surrounding the piston rod between the one end of the barrel and the piston is a compressible helical spring. A hand grip attached to the barrel is provided with a spring-biased trigger having a latching finger which when the trigger is inactive extends into a slot in the barrel. In operation, the player first pulls the handle to cause the piston to advance toward the one end of the barrel until it is engaged and latched by the latching finger, the spring then being compressed and the gun being cocked. To fire the gun, the player actuates the trigger to unlatch the piston which then is driven by the expanding spring toward the other end of the barrel to produce a compressed air pulse that is delivered to the launching tube.

7 Claims, 5 Drawing Sheets

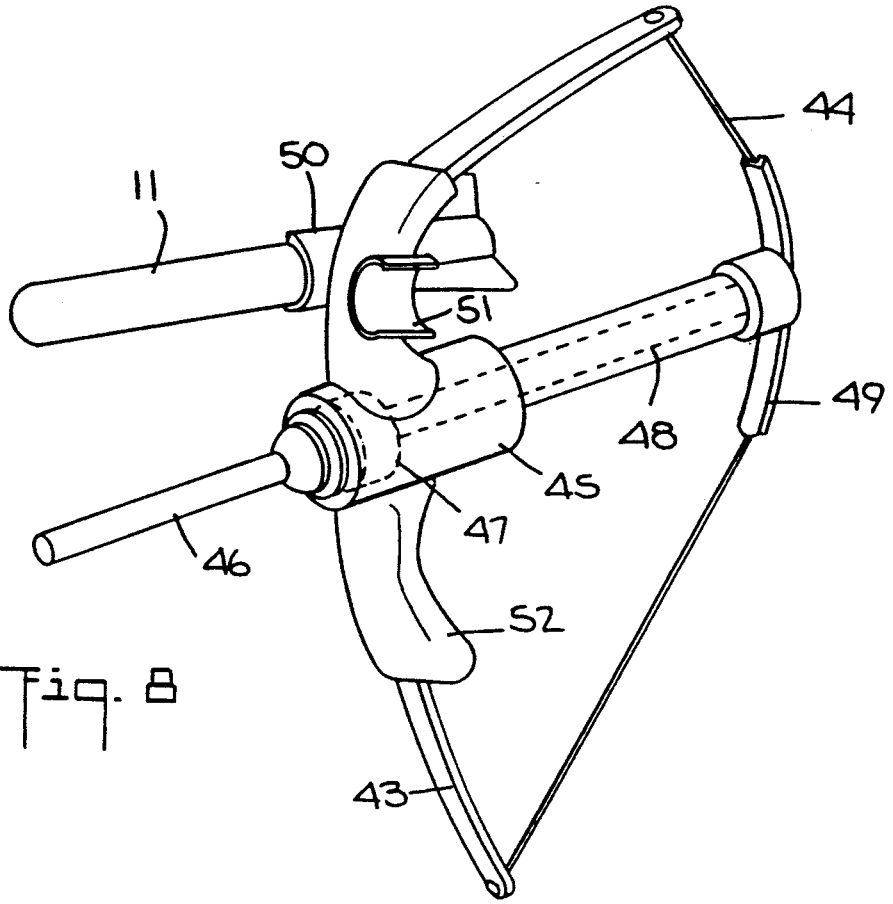
Fig. 8
Fig. 9
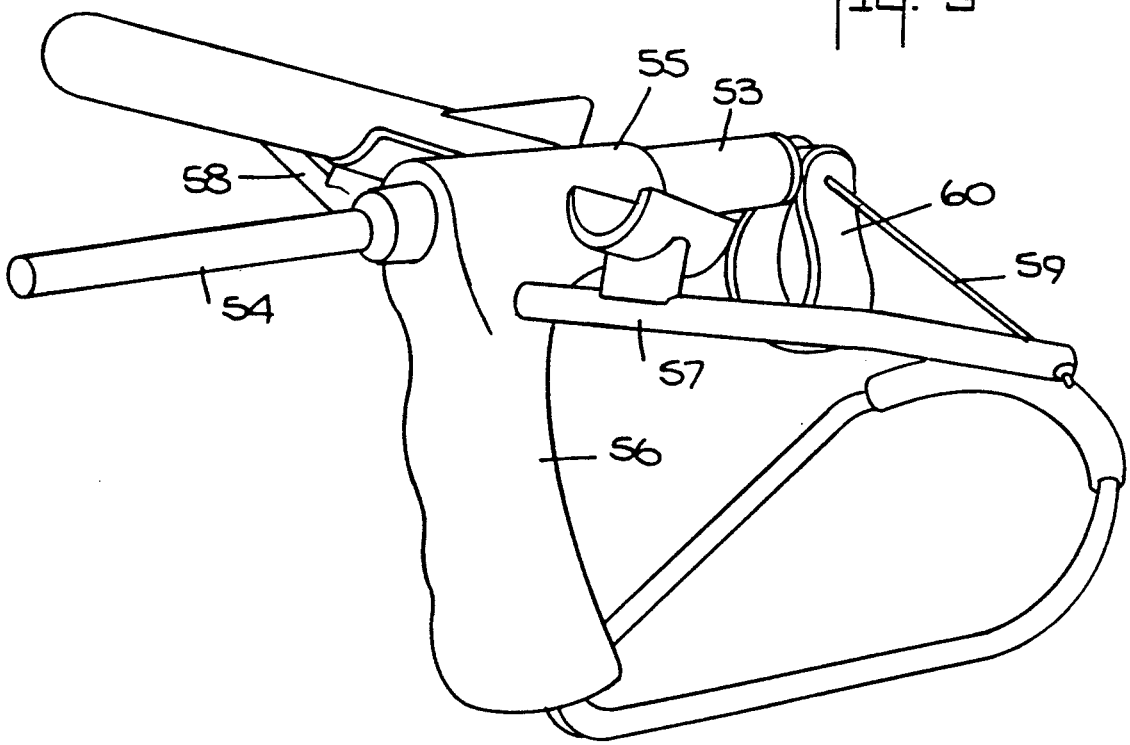

AIR-PULSE POWERED TOY BOW AND ARROW SET

BACKGROUND OF INVENTION

1. Field of Invention

This invention relates generally to arrow shooting toys, and more particularly to a toy set that includes an air gun which when fired produces a pulse of compressed air which acts to shoot the arrow off a launching tube to which the pulse is delivered.

2. Status of Prior Art

The use of bow and arrows for hunting and war dates back to antiquity. These were widely used in ancient Egypt, Persia and North and South Africa. American Indians and the English were particularly skillful archers. The heads of arrows were first made of burnt wood, then of flint or bone, later of bronze and finally of steel. The cross bow developed in the Middle Ages was far more powerful than an ordinary bow, but it took a ratchet mechanism to bend the cross bow.

Children have never lost their fascination with bows and arrows, and toy versions thereof are used in archery and in playing many games, such as cowboys and Indians. But parents have not shared their children's enthusiasm for toy bows and arrows, for parents have a continuing concern with possible injury from relatively stiff toy arrows, even those whose heads are of soft material or are blunt.

Presently on the market is a Parker Brothers "Bow 'N Arrow" toy set, the arrows of which are formed of soft, foam plastic material to which guide fins are attached, the arrow having an axial bore in its rear section, so that the arrow can be slidably received on a launching tube which then extends into the bore. Attached to the midsection of the bow is a rearwardly-extending barrel having a spring-biased piston slidable therein. The piston is joined to a piston rod which extends from the rear end of the barrel and is joined to a grip or handle. Projecting forwardly from the midsection of the bow and communicating with the front end of the barrel is the launching tube.

When a player pulls the handle back and then releases it, the piston is then driven toward the front end the barrel to compress the air therein and produce an air pulse that is delivered to the launching tube to shoot off the arrow mounted therein.

This known type of set which fires a soft arrow can safely be used for target practice, distance challenges and for playing games such as tag. However, one practical drawback of this set is that it cannot be cocked; that is to say, set for firing before the arrow is aimed. The player is required to hold the handle in its pulled back position while he aims the arrow; for the moment he lets go of the handle, the arrow will shoot off the launching tube.

A similar soft, arrow is disclosed in the Bednar et al. U.S. Pat. No. 2,993,297 in which an arrow-like rocket is slipped over a launching tube which is held by the player, the tube being coupled by tubing to a compressible rubber bulb. When the bulb is compressed by the foot of the player, the resultant pulse of compressed air is delivered by the launching tube to the rocket, causing it to take off.

In the Fertig et al. U.S. Pat. No. 4,897,065, a foam plastic toy airplane is mounted on a launching tube to which a pulse of compressed air is supplied by a hand-operated cylinder and piston. A similar pump arrangement is provided in the compressible, soft foam plastic ball launcher disclosed in the Moormann U.S. Pat. No. 4,892,081.

SUMMARY OF INVENTION

In view of the foregoing, the main object of this invention is to provide a bow and arrow set is safe for children to play with, the set including air gun which when fired produces an air pulse for propelling a soft and innocuous arrow.

More specifically, an object of this invention is to provide a set of the above type in which the air gun is trigger-operated and can be cocked so that the arrow can be aimed before it is fired.

Also an object of the invention is to provide a toy bow and arrow set of the above type which includes a cord tied to the ends of the bow similar to that used in a conventional bow, but not functioning to propel the arrow, yet behaving as if it did, thereby simulating a conventional bow operation.

Yet another object of the invention is to provide a simplified arrow shooting set in which the air gun producing an air pulse is driven by a cord attached to the bow.

A further object of this invention is to provide a toy bow and arrow set that operates efficiently and reliably, and can be manufactured at relatively low cost.

Briefly stated, these objects are attained in an air-pulse powered arrow shooting toy set provided with at least one soft arrow whose shaft is formed of resilient, flexible foam material, the rear section of the shaft having an axial bore so that the arrow is slidable onto a launching tube which then extends into the bore. Coupled to the tube is an air gun which, when cocked and then fired, produces a compressed air pulse which is delivered to the launching tube to shoot off the arrow.

The air gun includes a barrel having a piston slidable therein which is attached to a piston rod that extends out of one end of the barrel to join a handle. Surrounding the piston rod between the one end of the barrel and the piston is a compressible helical spring. A hand grip attached to the barrel is provided with a spring-biased trigger having a latching finger which when the trigger is inactive extends into a slot in the barrel.

In operation, the player first pulls the handle to cause the piston to advance toward the one end of the barrel until it is engaged and latched by the latching finger, the spring then being compressed and the gun being cocked. To fire the gun, the player actuates the trigger to unlatch the piston which then is driven by the expanding spring toward the other end of the barrel to produce a compressed air pulse that is delivered to the launching tube.

BRIEF DESCRIPTION OF DRAWINGS

For a better understanding of the invention as well as other objects and further features thereof, reference is made to the following detailed description to be read in conjunction with the accompanying drawing, wherein:

FIG. 8 is a perspective view of a third embodiment of a bow and arrow set having an air gun that is powered by a bow string; and FIG. 9 is a perspective view of a fourth embodiment of a bow and arrow set whose air gun is powered by a bow string.

DESCRIPTION OF INVENTION

First Embodiment

Figure 1:
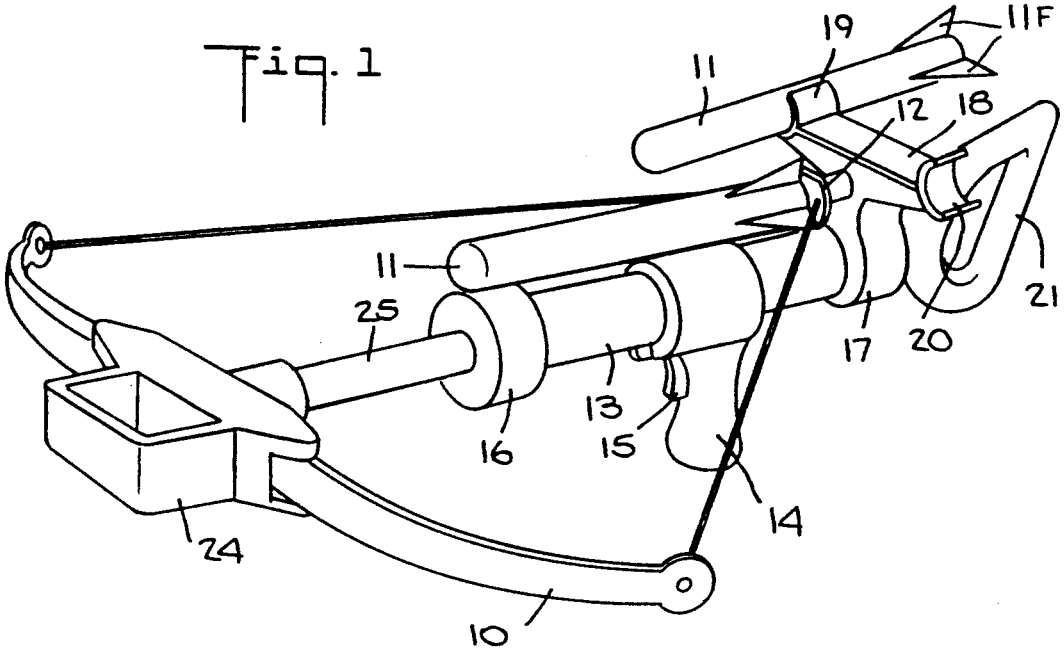
FIG. 1 is a perspective view of one embodiment of a toy bow and arrow set in accordance with the invention that includes an air gun, the set being shown in its condition prior to operation.
Figure 2:
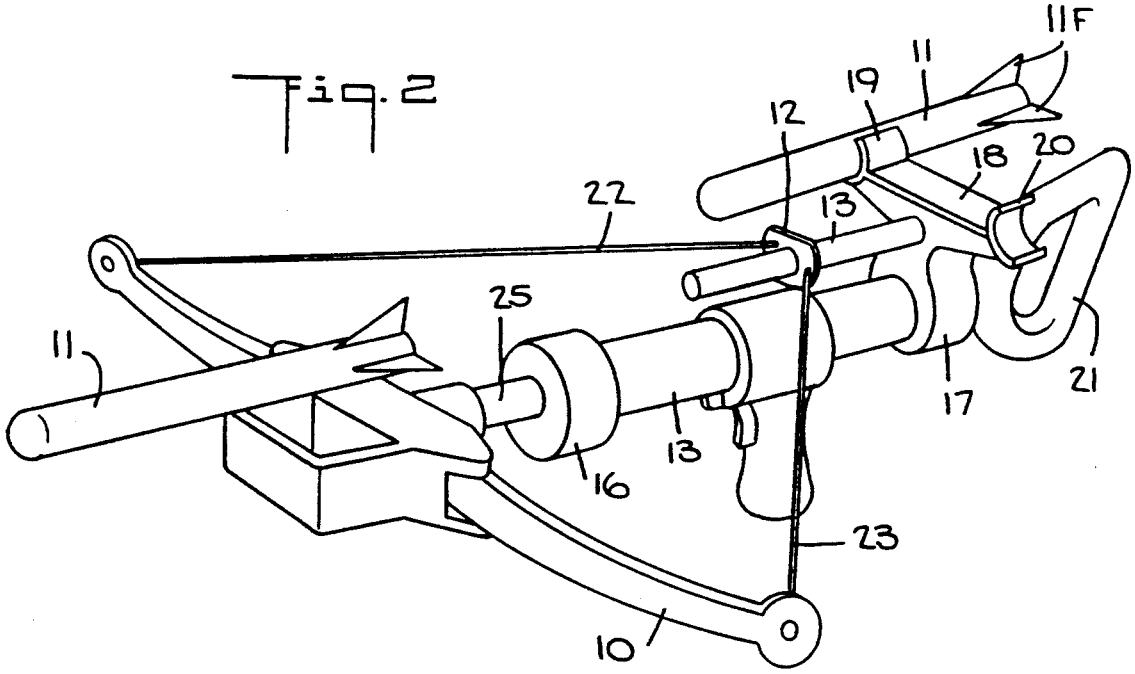
FIG. 2 is the same as FIG. 1, except that the gun has been fired and its arrow has been launched.

Referring now to FIGS. 1 and 2, there is shown a toy bow and arrow set in accordance with the invention, the set including a bow 10 molded of flexible, synthetic, plastic material, such as polyvinyl chloride, polyethylene or polypropylene. Also included are two identical soft arrows 11, one being stored, and the other being mounted on a launching tube 13.

The set further includes an air gun comprising a cylindrical barrel 13 molded of synthetic plastic material having laterally attached thereto at an intermediate position thereon a hand grip 14 provided with a spring-biased trigger 15. The front end of barrel 13 is capped by a collar 16. The rear end of the barrel is attached to an air chamber 17 to which launching tube 13 is also secured so that the tube projects forwardly in parallel relation to the rear section of the barrel.

Mounted above air chamber 17 is a platform 18 having a pair of arcuate clamps 19 and 20 to store arrows 11 when not in use. Behind chamber 17 and secured thereto is a rear handle 21.

Slidable on launching tube 13 is an annular disc 12 whose opposite sides are connected by strings 22 and 23 to the extremities of bow 12, these strings simulating the cord of a conventional crossbow. When, as shown in FIG. 1, an arrow 11 is mounted on the launching tube, disc 12 is then behind the arrow.

A fixture having a handle 24 is attached to bow 10 at its midsection, the handle being in front of the bow. Attached to the fixture and projecting rearwardly therefrom is a piston rod 25 which extends into the barrel through collar 16 at its front end.

Figure 3:
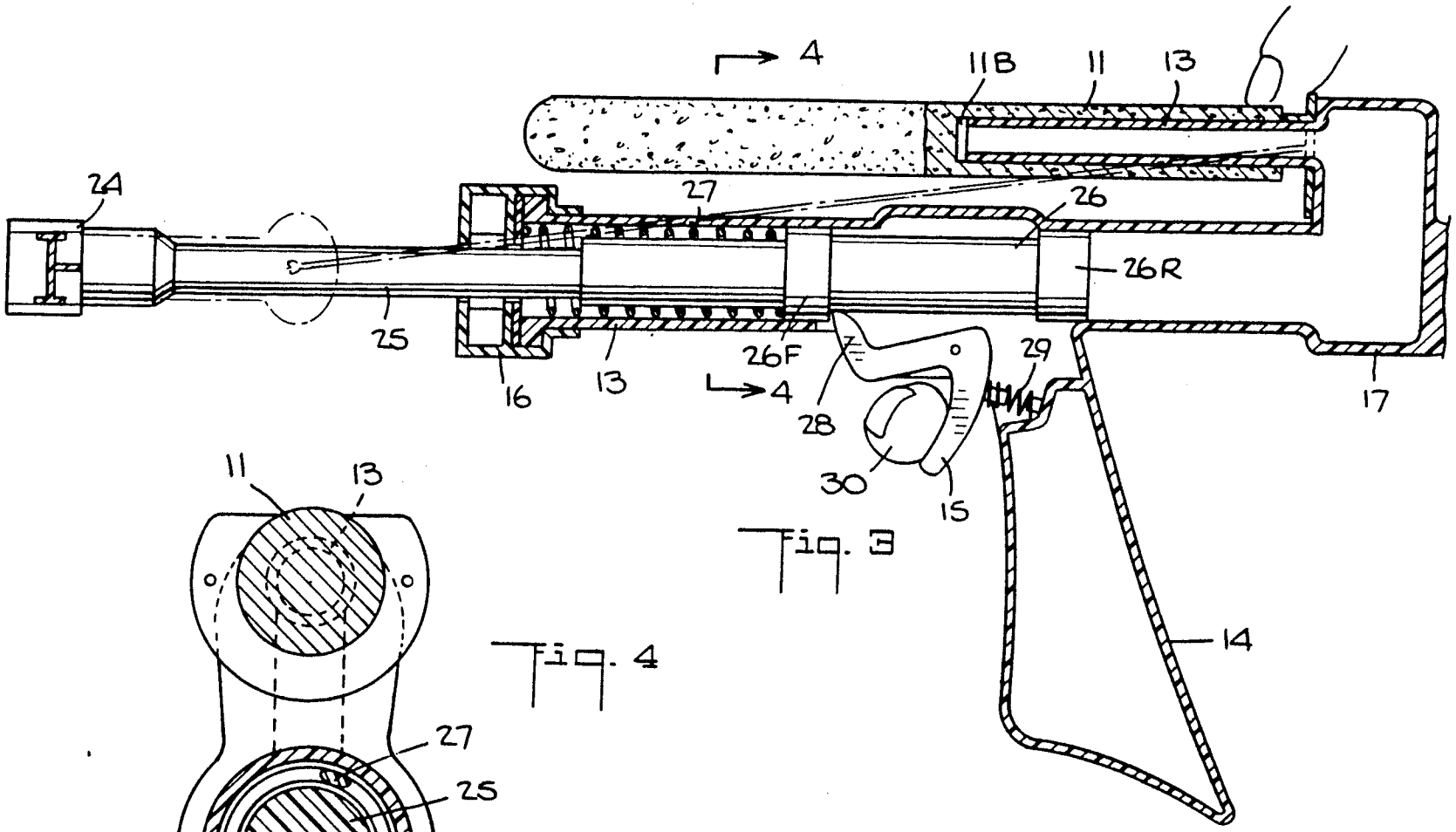
FIG. 3 is a longitudinal section taken through the first embodiment of the set when the gun is in its cocked state.
Figure 4:
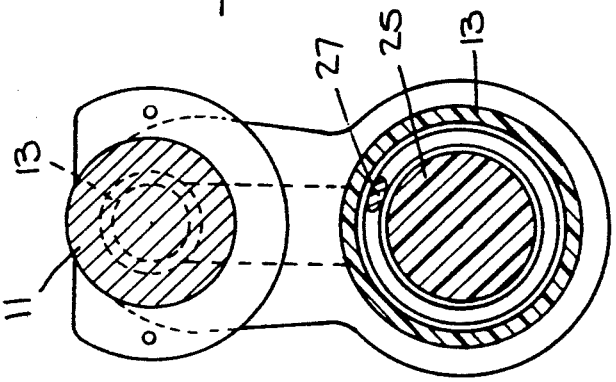
FIG. 4 is a transverse section taken in the plane indicated by line 4—4 in FIG. 3.

As shown in FIGS. 3 and 4, piston rod 25 is joined to an elongated piston 26 which is slidable in barrel 13. The piston is provided with enlarged cylindrical front and rear heads 26F and 26R whose diameters substantially match the inner diameter of the barrel so that little air can pass through the piston. Surrounding piston rod 25 between collar 16 at the front end of the barrel and the front head 26F of the piston is a compressible helical spring 27, which when the gun is cocked is compressed, the spring expanding when the gun is fired.

Cocking is effected by a latching finger 28 which enters a slot in the barrel, the finger being integral with trigger 15 of the gun. This trigger is biased by a small spring 29 which urges latching finger 28 into the barrel slot so as to engage piston 26 at the shoulder between the piston body and its enlarged front head 26F.

Arrow 11, a shown in FIGS. 1 and 2, is provided at its rear section with guide fins 11F. The shaft of the arrow is formed of soft, resilient, foam plastic material such as polyurethane foam, and is provided at its rear section, as shown in FIG. 3, with an axial bore 11B whose length is almost as great as that of launching tube 13 and whose diameter is about the same. Hence in play, the arrow is slipped onto the tube. When so mounted on the launching tube, the arrow serves to block the open front end of the launching tube so that a compressed air pulse fed into the tube impinges on the arrow to shoot it off the tube.

Air chamber 17 functions to air couple launching tube 13 to the rear end of barrel 1's o that air compressed in the barrel when the gun is fired is delivered to the tube.

To cock the air gun, the player holds rear handle 21 in one hand while with his other hand he pulls front handle 24 to advance piston 26 toward the front end of the barrel and thereby compress spring 27, as shown in FIG. 3. When in the course of this advance front head 26F of the piston is brought in front of latching finger 28, the finger is then urged by the trigger spring into the shoulder between the enlarged head and the body of the piston, thereby preventing movement of the piston toward the rear end of the barrel and maintaining spring 27 in its compressed state. At this point, the gun is cocked and is ready to be fired. This cocking action permits the player to carefully aim the arrow at a selected target before firing the gun.

To fire the gun, the player who is grasping grip 14 with one hand then actuates trigger 15 with a finger 30 of this hand, this action causing latching finger 28 to be withdrawn to release the piston. The released piston is driven by the expanding spring 27 toward the rear end of barrel 13. As rear head 26R of the piston advances, it acts to compress the air in chamber 17 coupled to the rear end of the barrel to produce a compressed air surge or pulse which is delivered to launching tube 13 coupled to the air chamber.

Figure 5:
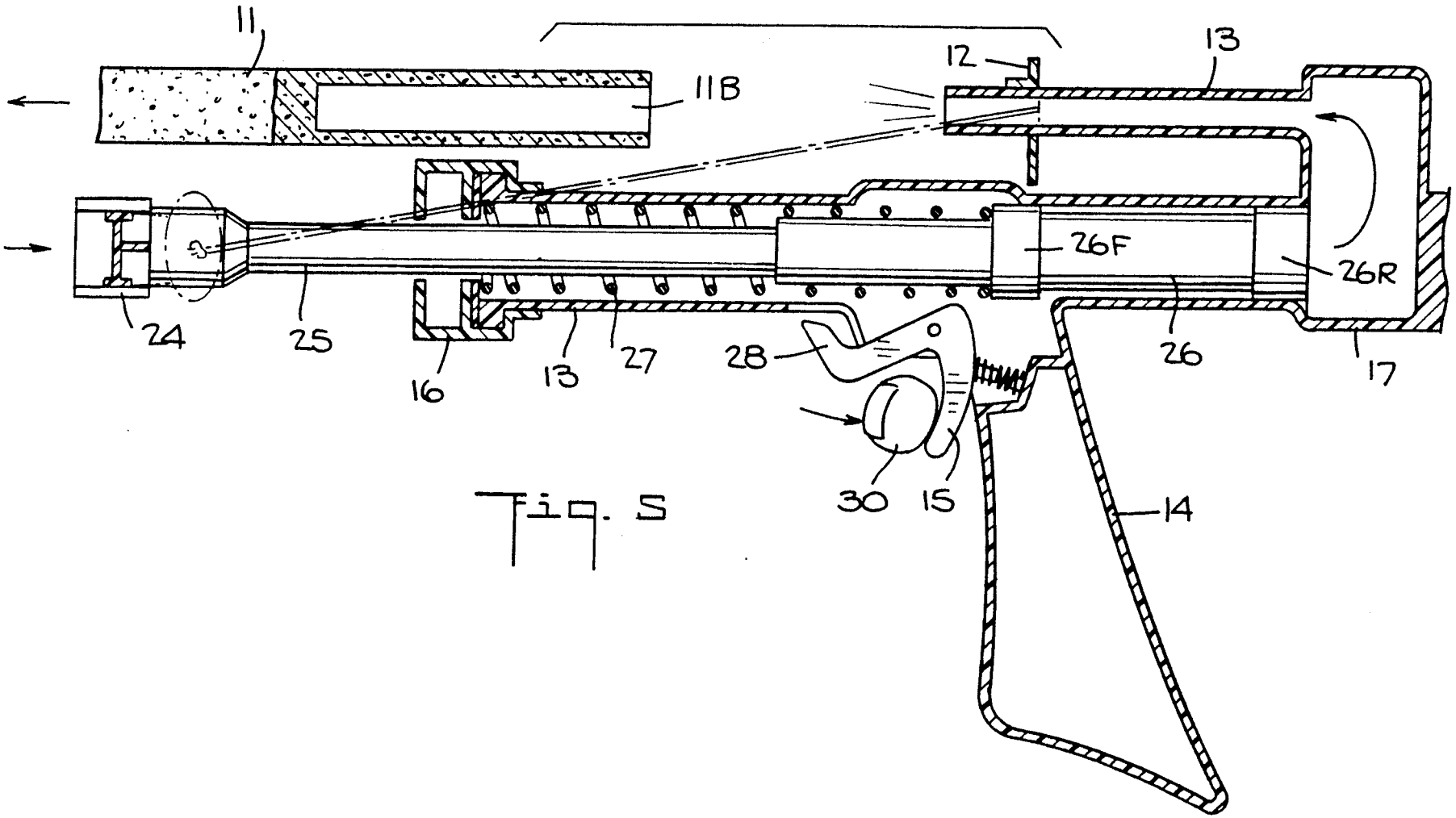
FIG. 5 is the same as FIG. 4, except that the gun has been fired and the arrow launched.

As shown in FIG. 5, the air pulse which impinges on the arrow acts to shoot arrow 11 off launching tube 13 with sufficient force to propel it in the direction in which the arrow is aimed before the gun is fired. But because the arrow is of soft material and has a blunt nose, even if it strikes a human target at a short distance from the set, it will inflict no injury. In practice, the power of the air gun is sufficient to propel the arrow thirty or more feet.

When the arrow is shot off the launching tube, disc 12 is no longer held in place by the arrow and is then pulled forward by strings 22 and 23. These strings, which simulate the cord of a conventional crossbow, then angle out, this being similar to the action which takes place when the cord of a crossbow is pulled out to flex the bow and then released to fire an arrow. Thus the action of the set simulates that of a crossbow.

In practice, the strings may be made of a strechable line, or the bow may have sufficient resilience to pull the strings forward when the arrow is launched.

Thus the first embodiment of the bow and arrow set is easy to operate; for all the player has to do is to pull out the piston rod of the gun to cock the gun, at which points he can aim the arrow in any desired direction; and when he is satisfied with his aim, he can then fire the air gun to shoot off the arrow.

Second Embodiment

Figure 6:
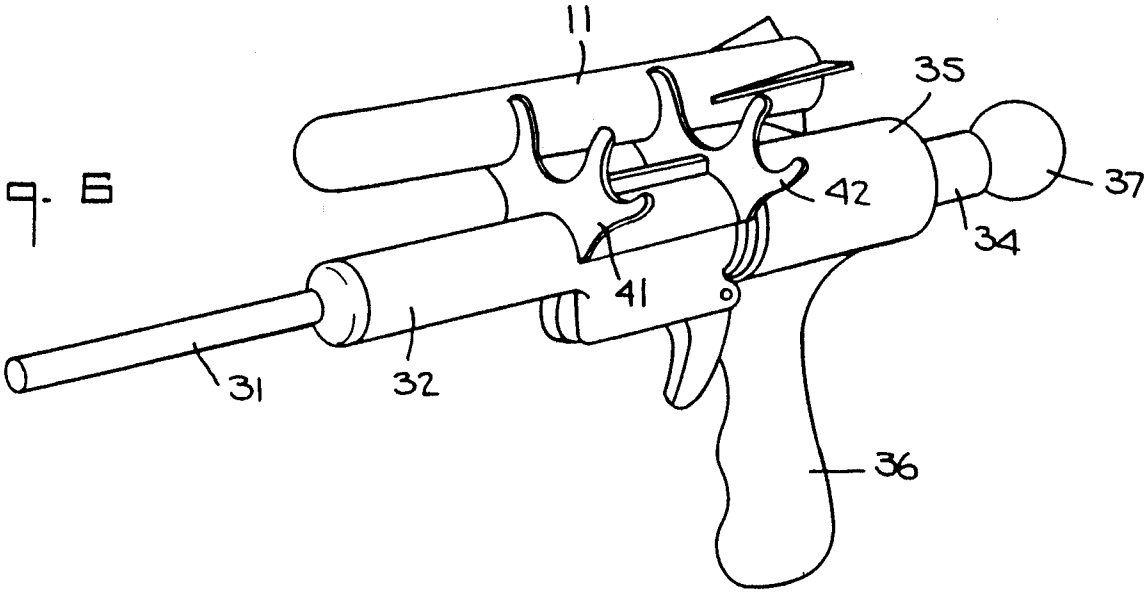
FIG. 6 is a perspective view of a second embodiment of an arrow shooting set that includes a spring-operated air gun.
Figure 7:
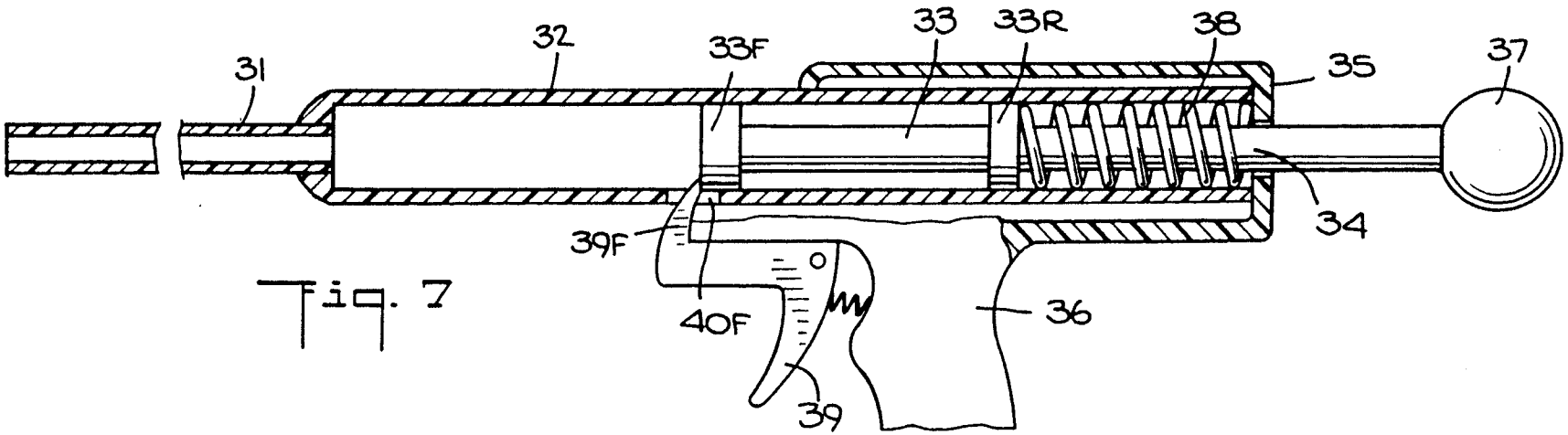
FIG. 7 is a longitudinal section taken through FIG. 6.

In the embodiment shown in FIGS. 6 and 7, no attempt is made to simulate a bow. But arrows 11 are the same as those in the first embodiment and are received on a launching tube 31. This tube is attached to and projects from the front end of barrel 32 of an air gun, the axis of the tube being colinear with the axis of the cylindrical barrel.

Slidable in the barrel is a piston 33 having an enlarged head 33F and an enlarged rear head 33R, the piston being joined to a piston rod 34 which extends from rear head 33R through a rear port in a barrel holder 35 integral with a hand grip 36, the piston rod being joined to a globular handle 37. Surrounding piston rod 34 between rear head 33R and the rear end of the barrel is a helical spring 38.

Grip 36 is provided with a trigger 39 biased by a small spring 38. Integral with trigger 39 is a latching finger 39F that enters a slot 40F in the barrel to engage the front face of front head 33F of the piston. Hence to power this air gun, the player pulls out piston rod 34 by means of handle 37 to compress spring 38 and to permit latching finger 39F to engage the front head of the piston, the spring then being maintained in its compressed state and the gun being cocked.

Then the player mounts an arrow of a launching tube 31 and aims it toward a selected target, after which he actuates trigger 37 to fire the arrow. When the gun is fired to unlatch the piston, front piston head 33F is driven by expanding spring 38 toward the front end of the barrel to compress the air therein and produce an air pulse which is delivered to the launching tube to shoot off the arrow slidably mounted thereon.

Barrel holder 35 is provided with bridge pieces 41 and 42 having arcuate slots to accommodate two stored arrows.

Third Embodiment

The embodiment shown in FIG. 8 is closer to a conventional bow and arrow arrangement, in that it includes a bow 43 of flexible material and a cord 44 tied to the extremities of the bow. When the player holds the bow in one hand and pulls on the cord with his other hand, the bow is then flexed to a degree that depends on the strength of the player.

However, in this embodiment, attached to the midsection of the bow is a rearwardly-extending barrel 45 having a launching tube 46 projecting from the front end thereof. Slidable within the barrel is a piston 47 which is joined by a piston rod 48 to a flexible hand grip 49 joined to cord 44 at its midsection, so that when the cord is pulled back to flex the bow, and then released to permit the stressed bow to return to its normal state, this action causes the piston rod to advance the piston in the barrel to produce an air pulse to shoot off the arrow on the launching tube.

Arrows 11 are soft and have the same structure as the arrows in the other embodiments. They are stored in clamps 50 and 51 secured to the upper section of a handle 52 attached to barrel 45, the lower section being grasped by the player who holds the bow.

Fourth Embodiment

This embodiment, as shown in FIG. 9, is similar to that shown in FIG. 8, in that it includes a barrel 53 from whose front end projects a launching tube 54. Barrel 53 is held by a holder 55 having a hand grip 56. Extending from opposite sides of holder 55 are a pair of flexible arms 57 and 58 to form a bow whose extremities have a cord 59 tied thereto. Attached to the midsection of the cord is a U-shaped handle 60. Handle 60 is joined to the end of a piston rod that extends into the barrel and terminates in a piston.

In operation, the player, holding grip 56 in one hand, pulls out the piston rod by grasping handle 60 in his other hand. In doing so, the bow is flexed, and when handle 60 is released and the bow recovers its original state, the piston is driven in by the cord 56 to produce a pulse of air which acts to shoot the arrow off the tube.

While there have been shown and described preferred embodiments of an air-pulse powered toy arrow shooting set in accordance with the invention, it will be appreciated that many changes and modifications may be made therein without, however, departing from the essential spirit thereof.

I claim:

1. An air-pulse powered arrow shooting toy set adapted to simulate the operation of a crossbow weapon comprising:

(a) at least one soft arrow whose shaft is formed of resilient, plastic, foam material, said shaft having in its rear section an axial bore;

(b) a launching tube on which said arrow is slidably received, whereby the tube then extends into said bore and is air blocked thereby;

(c) a crossbow having a midsection and a pair of arms extending in opposite directions from the midsection, the extremity of each arm having one end of a string attached thereto; and (d) an air gun coupled to said tube to produce, when cocked and then fired, a compressed air pulse which is delivered to said tube to shoot off the arrow, said gun including:

a barrel having a piston slidable therein;

a piston rod attached to the piston and extending out of one end of the barrel to join the midsection of the crossbow whose strings are extended from said arms to said launching tube to simulate said weapon;

a compressible, helical spring surrounding the piston rod between said one end of the barrel and the piston; and a hand grip attached to the barrel and provided with a spring-biased trigger having a latching finger which enters a slot in said barrel, said finger, when the piston is pulled by the handle of the crossbow to compress said spring, then engaging and latching said piston to maintain the spring under compression and thereby cock the gun, said trigger, when actuated to fire the gun, unlatching the piston which is driven by the expanding spring toward the other end of the barrel to produce said air pulse.

2. A toy as set forth in claim 1, wherein said arrow is formed of polyurethane foam and is provided at its rear section with guide fins.

3. A toy set as set forth in claim 1, wherein said gun includes an air chamber coupled to the other end of the barrel and supporting said launching tube so that it is in parallel relation to the barrel, said air chamber air coupling said barrel to said tube whereby the air pulse is delivered to said tube.

4. A toy set as set forth in claim 1, further including a second handle attached to the rear of said air chamber, whereby to cock the gun, a player holds said crossbar handle with one hand to pull said piston while holding the second handle with his other hand.

5. A toy as set forth in claim 4, wherein said gun is provided with a platform mounted above the air chamber and having clamps to engage and store the arrows.

6. A toy as set forth in claim 1, further including an annular disc slidable on said launching tube and connected by said strings to the arms of said bow, said disc being behind said arrow when the arrow is received on said tube, and sliding forward on said tube when the arrow is shot off the tube.

7. A toy as set forth in claim 1, further including a barrel holder provided with means to store said arrows.

* * * * *